United States Patent [19]

Kozicki et al.

[11] Patent Number: 4,922,243

[45] Date of Patent: May 1, 1990

[54] VOLTAGE REGULATOR CIRCUIT FOR USE IN A PROGRAMMABLE MESSAGE DISPLAY

[75] Inventors: Andrzej Kozicki, Milan, Ill.; Leo C. Brower, Davenport, Iowa

[73] Assignee: Uticor Technology, Inc., Bettendorf, Iowa

[21] Appl. No.: 186,382

[22] Filed: Apr. 26, 1988

[51] Int. Cl.[5] ..... G09G 3/00

[52] U.S. Cl. ..... 340/813; 340/811; 315/169.1

[58] Field of Search ..... 340/813, 811, 805, 766, 340/771, 758; 315/169.1, 169.3, 169.4

[56] References Cited

U.S. PATENT DOCUMENTS

| | | | |
|---|---|---|---|
| 4,109,180 | 8/1978 | Ogle et al. | 340/813 |
| 4,472,660 | 9/1984 | Knothe et al. | 340/813 |
| 4,495,445 | 1/1985 | Turney | 340/813 |

*Primary Examiner*—Jeffery A. Brier
*Attorney, Agent, or Firm*—Brooks & Kushman

[57] ABSTRACT

A voltage regulator circuit provides an economical approach for maintaining the RMS filament voltage of vacuum fluorescent tubes within an acceptable voltage range during input supply voltage variations. The regulator circuit includes substantially identical upper and lower clipper circuits which clip the AC voltage of a step-down transformer secondary. The supply voltage is allowed to vary so that the secondary voltage is outside of the acceptable range of voltage defined by substantially identical voltage reference circuits. Each of the voltage reference circuits is coupled to its respective clipper circuit and to the center tap of the secondary winding of the transformer so that the regulator circuit and the clipped output voltage are symmetrical about the center tap. Th regulator circuit is simple and power-efficient while keeping the filament voltage within the acceptable range of voltages.

12 Claims, 4 Drawing Sheets

VOLTAGE REGULATOR CIRCUIT FOR USE IN A PROGRAMMABLE MESSAGE DISPLAY

TECHNICAL FIELD

This invention relates to voltage regulator circuits for maintaining the RMS drive voltage of electronic display elements in a programmable message display within an acceptable voltage range and, in particular, to voltage regulator circuits for maintaining the RMS filament voltage of vacuum fluorescent tubes in a programmable message display within an acceptable voltage range.

BACKGROUND ART

Electronic display elements, such as vacuum fluorescent tubes, have a predetermined acceptable range of filament voltages (i.e. typically plus or minus 10%). This voltage range is extremely critical for vacuum fluorescent displays. If the filament voltage is too high, vacuum fluorescent tubes have a lower life expectancy and oftentimes even result in damage to the displays. If the filament voltage is too low, the brightness of the display is lowered.

This limitation makes it difficult to supply filament voltages straight from a 50/60 Hz step-down transformer, especially for industrial applications where input supply voltages to such a transformer may vary 15% or more.

One current approach is to run the voltage straight from the 50/60 Hz step-down transformer secondary winding with the correct filament voltage. For industrial applications where the input supply voltage may vary plus or minus 15or more, the straight secondary approach will not keep the filament voltage within specification. If a filament over-voltage condition occurs for a significant period of time, the display life of the filament is greatly reduced.

Another approach for generating an AC filament voltage is to rectify and regulate the AC transformer secondary voltage to DC and then chop it at a 50% duty cycle back to AC at the necessary filament voltage. This approach addresses the problem of the filament voltage wandering outside its voltage specification. However, this approach has at least two drawbacks. For large vacuum fluorescent tubes with filament currents exceeding 0.5 amps, the size and number of components is increased. Also, the large amount of power dissipation is wasted on the rectifiers and regulators, thereby making this approach an expensive and undesirable alternative.

SUMMARY OF THE INVENTION

An object of the present invention is to provide a simple and power-efficient voltage regulator circuit for use in a programmable message display to keep the drive voltage for the display elements within an acceptable range of voltages.

Another object of the present invention is to provide an economical approach of limiting the RMS filament voltage of vacuum fluorescent tubes to its recommended voltage specification during input supply voltage variations outside of the recommended voltage specification.

Yet still another object of the present invention is to provide a voltage regulator circuit for use in a programmable message display system which clips the transformer secondary voltage to stay within an acceptable range of drive voltages.

In carrying out the above objects and other objects of the present invention, a voltage regulator circuit for use in a programmable message display is provided. The voltage regulator circuit maintains the RMS drive voltage of electronic display elements in the programmable message display within an acceptable range. The message display includes a microprocessor for providing control signals, a message memory for storing multiple messages in binary digital code and an electronic display device which includes the electronic display elements. The microprocessor is responsive to the output of the memory for causing the display device to display a message corresponding to the coded signal provided by the memory. The circuit includes a step-down transformer having a primary winding and a secondary winding. The primary winding is adapted to be coupled to an input supply voltage. The supply voltage is allowed to vary so that the secondary voltage is outside the acceptable range. The circuit also includes an AC voltage clipping means coupled to the secondary winding for clipping the transformer secondary voltage as a function of a predetermined reference voltage which defines the acceptable range and provides a clipped output drive voltage for driving the display elements.

Preferably, the electronic display elements are vacuum fluorescent tubes having filaments to which the clipped output voltage is applied.

Also, preferably, the clipping means includes a pair of substantially identical voltage clipper circuits coupled to the secondary winding and reference voltage means coupled to each of the clipper circuits for providing the reference voltage to each of the clipper circuits.

The reference voltage means preferably includes a pair of substantially identical bidirectional voltage reference circuits, each of which is coupled to its respective voltage clipper circuit and to a center tap of the secondary winding to provide the reference voltage to its respective clipper circuit.

The voltage regulator circuit is symmetrical about the center tap of the secondary winding so that it operates on opposite phases of the transformer secondary winding voltage at substantially the same time. The clipped output voltage is symmetrical with reference to the center tap of the secondary winding.

The advantages accruing to the use of the above regulator circuit are numerous. For example, the circuit provides an inexpensive, simple, and power-efficient approach for driving filaments of vacuum fluorescent tubes.

The objects, features and advantages of the present invention are readily apparent from the following detailed description of the best mode for carrying out the invention when taken in connection with the accompanying drawings.

BEST MODE FOR CARRYING OUT THE INVENTION

Figure 1:
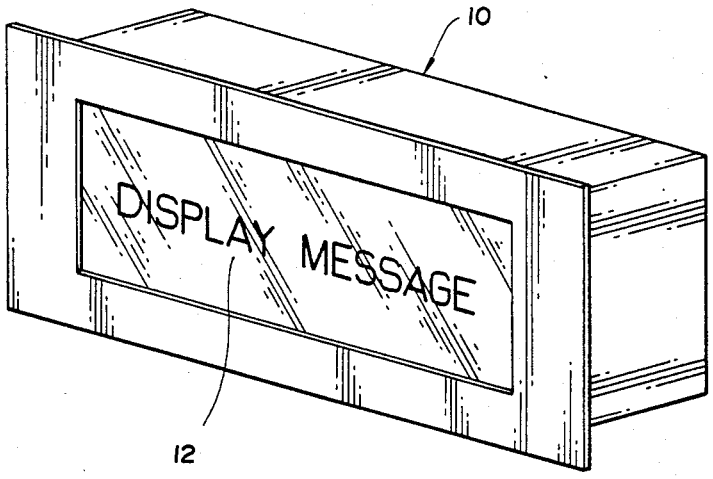
FIG. 1 is a perspective view of a programmable message display utilizing the voltage regulator circuit of the present invention.

Referring now to FIG. 1 there is illustrated a programmable message display, generally indicated at 10. The display 10 is adapted to convey information, for example, from an automated operation to various work stations in a manufacturing facility.

The display 10 of FIG. 1 displays stored messages on four lines of 20 characters each. The display 10 includes a plurality of display elements in the form of vacuum fluorescent tubes 12 which are driven at their filaments from a voltage regulator circuit, generally indicated at 16 in FIG. 2. In general, the regulator circuit 16 maintains the RMS filament voltage of the tubes 12 within an acceptable range.

Figure 2:
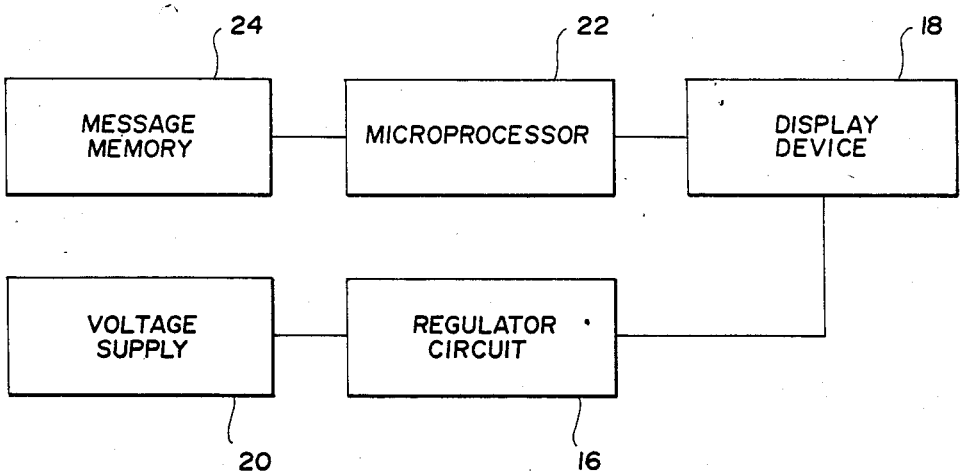
FIG. 2 is a block diagram of the programmable message display including the voltage regulator circuit.

The tubes 12 form part of a larger display device 18 as shown in FIG. 2. The display device typically includes circuitry (not shown) for selecting which of the tubes 12 are to be energized under control of a microprocessor 22.

A voltage supply 20 has a variable service power of 115/230 volts AC (i.e. 102–132 and 194–250 volts) and has an input frequency of 47 to 67 Hz. The input supply voltage to the display 10 may vary plus or minus 15% to accommodate the use of the message display 10 in various industrial applications.

The microprocessor 22 is, preferably, a Motorola 68,000 16-bit microprocessor, which provides control signals to control the display device 18. A message memory 24, which is preferably an EEROM, provides a storage for thousands of selected messages stored in a binary digit code. The microprocessor 22 is responsive to the output of the memory 24 for causing the display device 18 to display a message corresponding to the coded signal provided by the memory 24.

Figure 3:
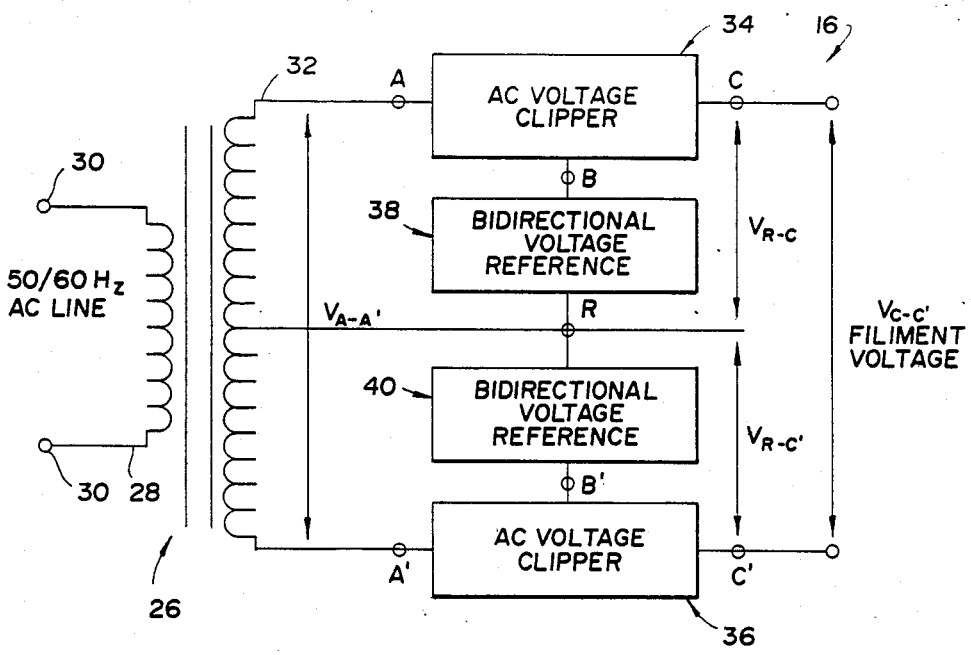
FIG. 3 is a general schematic diagram of the voltage regulator circuit.

Referring now to FIG. 3, there is illustrated in general schematic form the voltage regulator circuit 16. The voltage regulator circuit 16 includes a step-down transformer, generally indicated at 26, having a primary winding 28 which is coupled to the voltage supply 20 at nodes 30 and a secondary winding 32. The output voltage from the secondary winding 32 appears across nodes A and A' as $V_{A\text{-}A'}$.

Node A is electrically connected to a first AC voltage clipper circuit 34 and the node A' is electrically connected to a substantially identical second AC voltage clipper circuit 36. The clipper circuits 34 and 36 clip the secondary voltage of the transformer 26 as a function of a predetermined reference voltage which defines the acceptable range of voltages. The clipper circuits 34 and 36 provide a clipped output drive voltage, $V_{C\text{-}C'}$, to the filaments of the tubes 12 at nodes C and C'

The voltage clipper circuits 34 and 36 are, in turn, electrically connected to substantially identical bi-directional voltage reference circuits 38 and 40 at nodes B and B', respectively. The reference circuits 38 and 40 provide the reference voltage to their respective clipper circuits 34 and 36. Each of the voltage reference circuits 38 and 40 is also electrically connected at a common node R to a center tap of the secondary winding 32.

Because the clipped circuits 36 and the bidirectional voltage reference circuits 38 and 40 are substantially identical, the regulator circuit 16 is symmetrical about the center tap of the secondary winding 32. In this way, the voltage regulator circuit 16 operates on opposite phases of the voltage, $V_{A\text{-}A'}$, at the same time and the clipped output voltage, $V_{C\text{-}C'}$ is symmetrical with reference to the center tap of the secondary winding 32 and includes the voltage components $V_{R\text{-}C}$ and $V_{R\text{-}C'}$.

Figure 4:
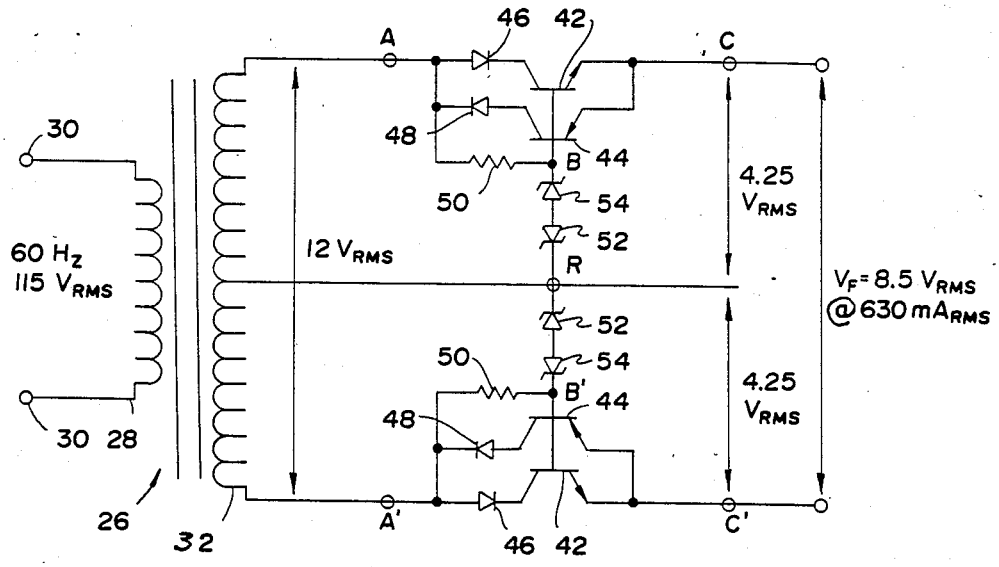
FIG. 4 is a detailed schematic diagram of the circuit.

Referring now to FIG. 4, there is illustrated in detail the various circuit elements which comprise the circuits 34, 38, 40 and 36 in FIG. 3. In particular, each of the voltage clipper circuits 34 and 36 includes a pair of complimentary transistors 42 and 44 having their bases and their emitters coupled together. Each of the pairs of complimentary transistors 42 and 44 conduct in either direction only when the transformer's secondary voltage, $V_{A\text{-}A'}$, is within the acceptable voltage range defined by the reference voltage provided by each of the voltage reference circuits 38 and 40.

Each of the voltage clipper circuits 34 also includes a pair of protection diodes 46 and 48. Each of the protection diodes 46 and 48 is connected to the secondary winding 32 at node A and also is connected to the collector of its respective transistor 42 and 44.

The voltage clipper circuits 34 and 36 include two biasing resistors 50. One of the resistors 50 is electrically connected between the nodes A and B of the first voltage clipper circuit 34 and the other of the resistors 50 is connected between the nodes A' and B' of the second voltage clipper circuit 36.

Each of the voltage reference circuits 38 and 40 includes a pair of zener diodes 52 and 54 having their anodes coupled together to provide the reference voltage which in the example illustrated, is 6.2 volts.

Figure 5:
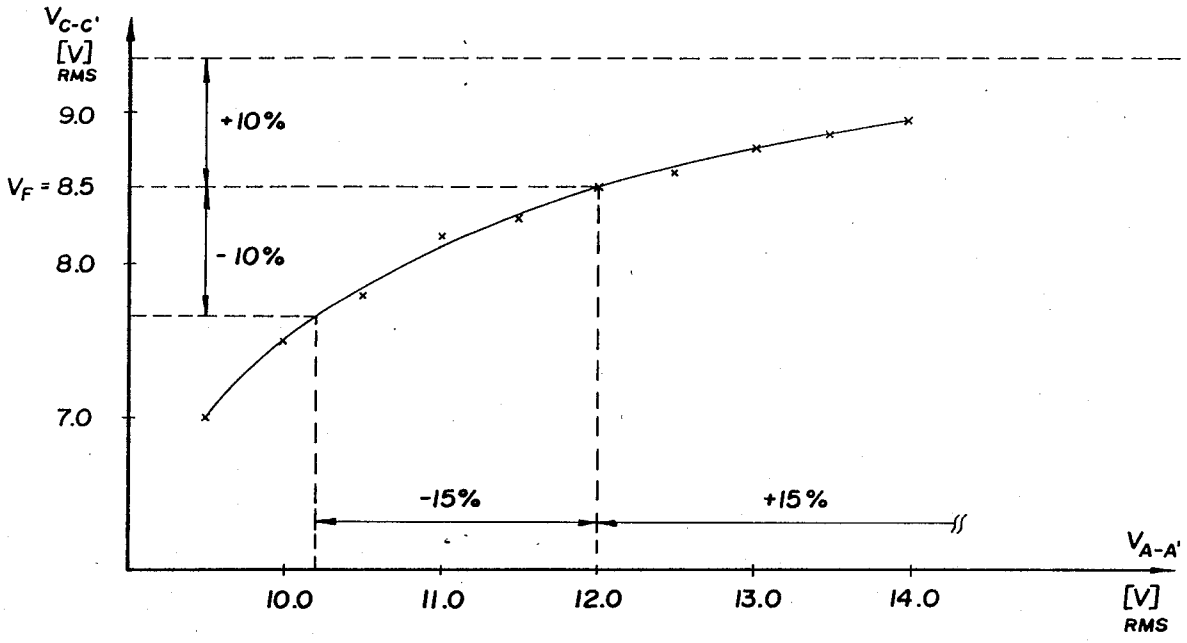
FIG. 5 is a graph illustrating the various input and output voltages of a particular vacuum fluorescent display.

Referring now to FIG. 5, there is illustrated the input and output voltage relation for a particular vacuum fluorescent display with a filament voltage of 8.5 $V_{RMS}$ plus or minus 10% at 630 mA RMS. The regulator circuit 16 compensates for a voltage fluctuation of plus or minus 15% across nodes A and A' which ordinarily translates into a plus or minus 15% voltage variation at nodes C and C'.

Figure 6:
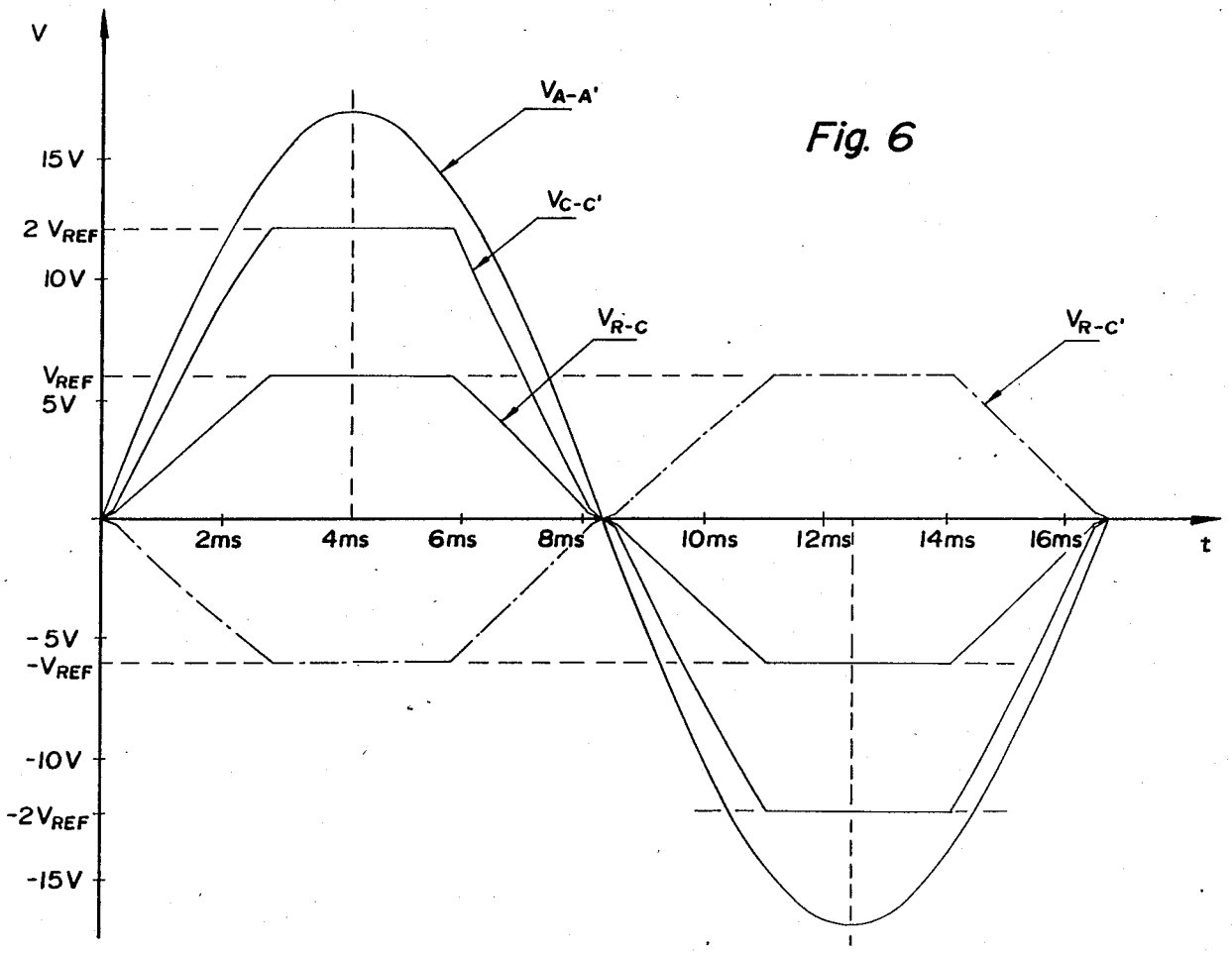
FIG. 6 is a graph illustrating the various input and output voltages versus time for the circuit of FIG. 4.

Referring now to FIG. 6, there is illustrated the various input and output voltages of the circuit 16 as a function of time. The voltage between nodes C and C', $V_{C\text{-}C'}$, is double the voltages between the reference node R and the nodes C and C', $V_{R\text{-}C}$ and $V_{R\text{-}C'}$, respectively. Because of the symmetry of the circuit 16, the center tap R of the transformer 26 can be easily polarized by the cathode offset voltage of the vacuum fluorescent display which is necessary for proper display function.

In order to obtain low power dissipation in the circuit 16, the secondary voltage of the transformer which appears across nodes A and A' should be chosen so that it is not much higher than the required output filament voltage.

The advantages accruing to the use of a voltage regulator circuit constructed in accordance with the present invention are numerous. For example, the voltage regulator circuit 16 provides a low cost, efficient solution for a vacuum fluorescent display which has high filament currents. The circuit 66 accommodates a supply voltage which changes more than 10% of its normal value.

While a preferred embodiment of the subject invention has been shown and described in detail, those skilled in this art will recognize various alternative designs and embodiments for practicing the present invention as defined by the following claims.

What is claimed is:

1. A voltage regulator circuit for maintaining the AC RMS drive voltage of electronic display elements in a programmable message display within an acceptable range, the message display including a microprocessor for providing control signals, a message memory for storing multiple messages in a binary digit code and an electronic display device having the electronic display elements, the microprocessor being responsive to the output of the memory for causing the display device to display a message corresponding to the coded signal provided by the memory, the circuit comprising:

a step-down transformer having a primary winding and a secondary winding, the primary winding being adapted to be coupled to an AC input supply voltage, the supply voltage being allowed to vary so that the AC secondary voltage is outside the acceptable range;

AC voltage clipping means coupled to the secondary winding for clipping opposite phases of the transformer AC secondary voltage as a function of a predetermined reference voltage which defines the acceptable range and provides a clipped AC output drive voltage for driving the display elements;

wherein said clipping means includes a pair of voltage clipper circuits coupled to the secondary winding and reference voltage means coupled to each of the clipper circuits for providing the reference voltages to each of the clipper circuits; and wherein the secondary winding has a center tap and wherein said reference voltage means includes a pair of bidirectional voltage reference circuits, each of said voltage reference circuits being coupled to its respective voltage clipper circuit and to the center tap to provide the reference voltage to its respective clipper circuit.

2. The invention as claimed in claim 1 wherein the electronic display elements are vacuum fluorescent tubes having filaments, and wherein the output drive voltage drives the tubes at the filaments of the tubes.

3. The invention as claimed in claim 1 wherein the voltage regulator circuit is symmetrical about the center tap of the secondary winding, so that the voltage regulator circuit operates on opposite phases of the transformer secondary winding voltage at the same time and the clipped output voltage is symmetrical with reference to the center tap of the secondary winding.

4. The invention as claimed in claim 3 wherein each of said voltage clipper circuits includes a pair of complement transistors having their bases coupled together and their emitters coupled together, wherein the pair of complement transistors conduct in either direction only when the transformer secondary voltage is within the acceptable range.

5. The invention as claimed in claim 4 wherein each of said voltage clipper circuits includes a pair of protection diodes, each of said diodes being coupled to said secondary winding and to the collector of its respective transistor.

6. The invention as claimed in claim 5 wherein each of said clipper circuits further includes a biasing resistor coupled to the secondary winding and to its respective voltage reference circuit.

7. The invention as claimed in claim 6 wherein each of said voltage reference circuits includes a pair of zener diodes having their anodes coupled together to provide its reference voltage.

8. A voltage regulator circuit for maintaining the peak RMS filament voltage of vacuum fluorescent tubes in the programmable message display within an acceptable range, the message display including a microprocessor for providing control signals, a message memory for storing multiple messages in a binary digit code and an electronic display device having the tubes, the microprocessor being responsive to the output of the memory for causing the display device to display a message corresponding to the coded signal provided by the memory, the circuit comprising:

a step-down transformer having a primary winding and a secondary winding having a center tap, the primary winding being adapted to be coupled to an input supply voltage, the supply voltage being allowed to vary so that the secondary voltage is outside the acceptable range; and AC voltage clipping means coupled to the secondary winding for clipping the transformer secondary voltage as a function of a predetermined reference voltage which defines the acceptable range and providing a clipped output voltage at the filaments of the tubes for driving the tubes, said clipping means including a pair of substantially identical voltage clipper circuits coupled to the secondary winding and a pair of substantially identical bidirectional voltage reference circuits, each of said voltage reference circuits being coupled to its respective voltage clipper circuit and to the center tap to provide the reference voltage to its respective clipper circuit, wherein the voltage regulator circuit is symmetrical about the center tap of the secondary winding so that the voltage regulator circuit operates on opposite phases of the transformer secondary winding voltage at the same time and the clipped output voltage is symmetrical with reference to the center tap of the secondary winding.

9. The invention as claimed in claim 8 wherein each of said voltage clipper circuits includes a pair of complement transistors having their bases coupled together and their emitters coupled together, wherein the pair of complement transistors conduct in either direction only when the transformer secondary voltage is within the acceptable range.

10. The invention as claimed in claim 9 wherein each of said voltage clipper circuits includes a pair of protection diodes, each of said diodes being coupled to said secondary winding and to the collector of its respective transistor.

11. The invention as claimed in claim 10 wherein each of said clipper circuits further includes a biasing resistor coupled to the secondary winding and its respective voltage reference circuit.

12. The invention as claimed in claim 11 wherein each of said voltage reference circuits includes a pair of zener diodes having their anodes coupled together to provide its reference voltage.

* * * * *

UNITED STATES PATENT AND TRADEMARK OFFICE

CERTIFICATE OF CORRECTION

PATENT NO. : 4,922,243

DATED : May 1, 1990

INVENTOR(S) : Andrzej Kozicki et al

It is certified that error appears in the above-identified patent and that said Letters Patent is hereby corrected as shown below:

Title page:

The correct name of one of the inventors should be

Leon C. Brower.

Signed and Sealed this

Eleventh Day of June, 1991

*Attest:*

HARRY F. MANBECK, JR.

*Attesting Officer*

*Commissioner of Patents and Trademarks*